US008794985B2

(12) United States Patent
Li et al.

(10) Patent No.: US 8,794,985 B2
(45) Date of Patent: Aug. 5, 2014

(54) CARD EDGE CONNECTOR

(75) Inventors: Zhuang-Xing Li, Kunshan (CN); Xue-Hai Shen, Kunshan (CN); Xue-Wu Bu, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 123 days.

(21) Appl. No.: 13/602,209

(22) Filed: Sep. 3, 2012

(65) Prior Publication Data

US 2013/0059455 A1 Mar. 7, 2013

(30) Foreign Application Priority Data

Sep. 1, 2011 (CN) ..... 2011 2 0325752

(51) Int. Cl.
*H01R 13/62* (2006.01)

(52) U.S. Cl.
USPC ..... 439/157

(58) Field of Classification Search
USPC ..... 439/157, 160
See application file for complete search history.

(56) References Cited

U.S. PATENT DOCUMENTS

| | | | | |
|---|---|---|---|---|
| 5,690,499 | A | 11/1997 | Howell et al. | |
| 6,599,142 | B2 * | 7/2003 | Bu | 439/157 |
| 8,002,563 | B2 * | 8/2011 | Li et al. | 439/160 |
| 8,517,746 | B2 * | 8/2013 | Manickam | 439/160 |
| 8,535,077 | B2 * | 9/2013 | Shen et al. | 439/328 |

* cited by examiner

*Primary Examiner* — Phuong Dinh
(74) *Attorney, Agent, or Firm* — Wei Te Chung; Ming Chieh Chang

(57) ABSTRACT

A card edge connector 100 includes an insulative housing 1, a plurality of contacts 2 and at least an ejector 3 pivoted on the housing 1. The housing 1 has an longitudinal central slot 12 and at least a towers portion 14 located at one ends of thereof. The ejector 3 comprise a pair of elastic walls 32, a slit formed between the elastic walls 32. the elastic wall 32 comprise a pair of first elastic walls 321 and a pair of second elastic walls 322 extending downwardly from the first elastic walls 321 respectively, the second elastic walls 322 comprises a first connecting wall 3221 and a second connecting wall 3222 extending downwardly from the first connecting wall 3221, a thickness of the first connecting wall 3221 is equal to a sum of the thickness of the first elastic wall 321 and the second connecting wall 3222.

14 Claims, 3 Drawing Sheets

CARD EDGE CONNECTOR

BACKGROUND OF THE INVENTION

1. Field of the Invention

The present invention generally relates to a card edge connector and more particularly to a card edge connector with an ejector.

2. Description of Related Art

U.S. Pat. No. 5,690,499, issued on Nov. 25, 1997, discloses a related card edge connector which is adapted for mounting a daughter card. The card edge connector includes an insulative housing, a plurality of contacts retained in the housing and two ejectors pivoted on the housing. The housing includes an elongated central slot for receiving the daughter card. The ejectors are pivoted on two longitudinal ends of the housing, each ejector comprises a base portion, a latch portion extending into the central slot from a top end of the base portion and an ejecting portion extending into the central slot from a bottom end of the base portion. The base portion includes a pair of elastic walls, a slit formed between the elastic walls and two protrusions located on two outsides thereof. The elastic walls include a pair of first elastic walls and a pair of second elastic walls extending downwardly from the first elastic walls respectively. In a width direction of the housing, a thickness of the second elastic wall is smaller than that of the first elastic wall, which can improve the elasticity of the ejector so as to prevent the protrusion from wearing in an open/close process of the ejector, but this configuration reduces the strength of the ejector and causes the ejector is deformed easily.

Hence, an improved card edge connector is desired to overcome the above problems.

SUMMARY OF THE INVENTION

According to one aspect of the present invention, a card edge connector, adapted for receiving a daughter card is formed with an elongated insulative housing, a plurality of contacts retained in the housing and a pair of ejectors pivoted on the housing. The housing comprises an elongated central slot and a pair of towers located at two opposite end thereof. The ejector including a pair of elastic walls, a slit formed between the elastic walls and a pair of protrusions at two outer sides of the elastic walls to abut against the tower. the elastic wall comprise a pair of first elastic walls and a pair of second elastic walls extending downwardly from the first elastic walls respectively, the second elastic walls comprises a first connecting wall upwardly connecting with the first elastic wall and a second connecting wall downwardly extending from the first connecting wall, a thickness of the first connecting wall is equal to a sum of a thickness of the first elastic wall and a thickness of the second connecting wall.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
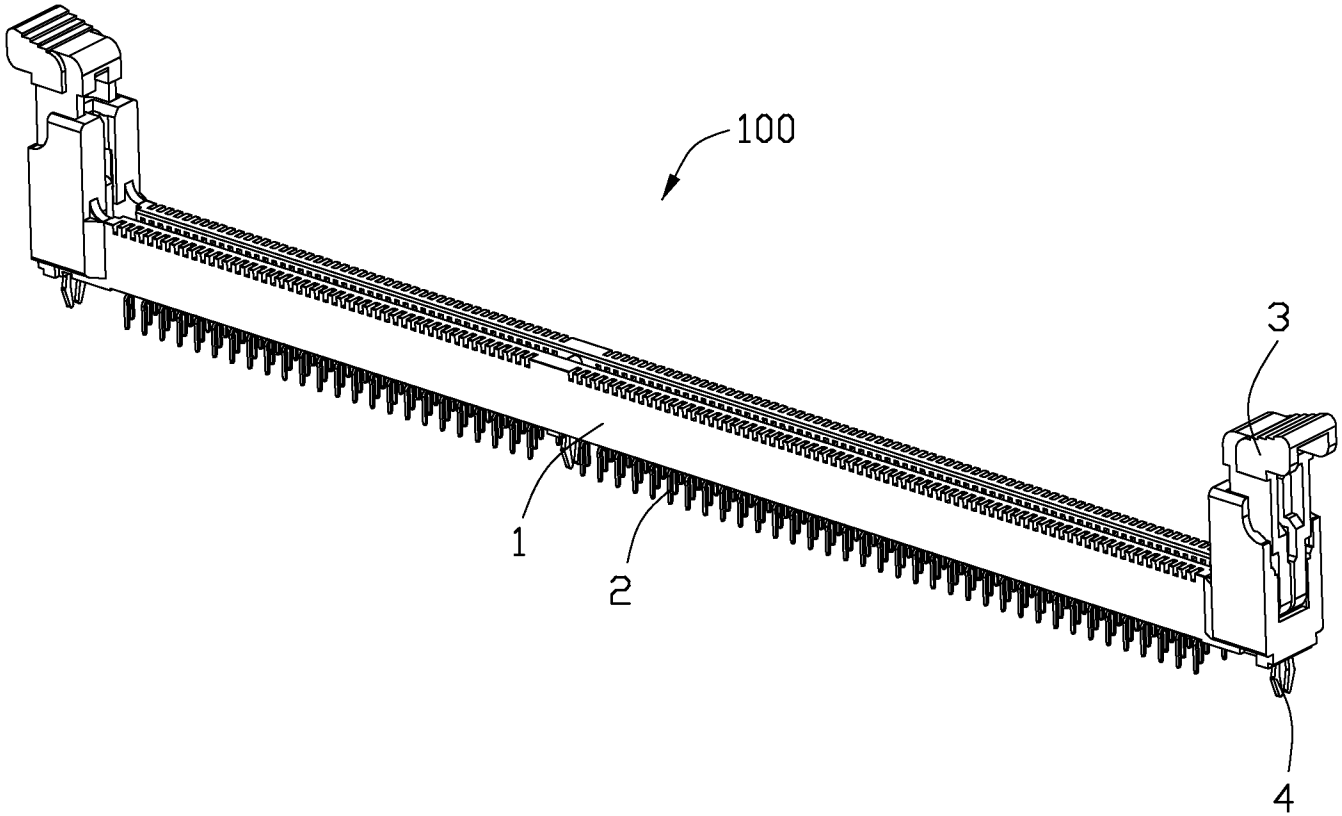
FIG. 1 is an assembled, perspective view of a card edge connector according to a preferred embodiment of the present invention.

Reference will be made to the drawing figures to describe the present invention in detail, wherein depicted elements are not easily shown to scale and wherein like or similar elements are designated by same or similar reference numeral through the several views and same or similar terminology.

Referring to FIG. 1, a card edge connector 100 in a preferred embodiment according to present invention is disclosed and adapted for accommodating a daughter card (not shown). The card edge connector 100 comprises an elongated insulative housing 1, a plurality of contacts 2 retained in the housing 1, a pair of ejectors 3 pivoted on the housing 1 and a pair of board lockers 4 mounted on a bottom side of the housing 1 to latch with a printed circuit board (not shown).

Figure 2:
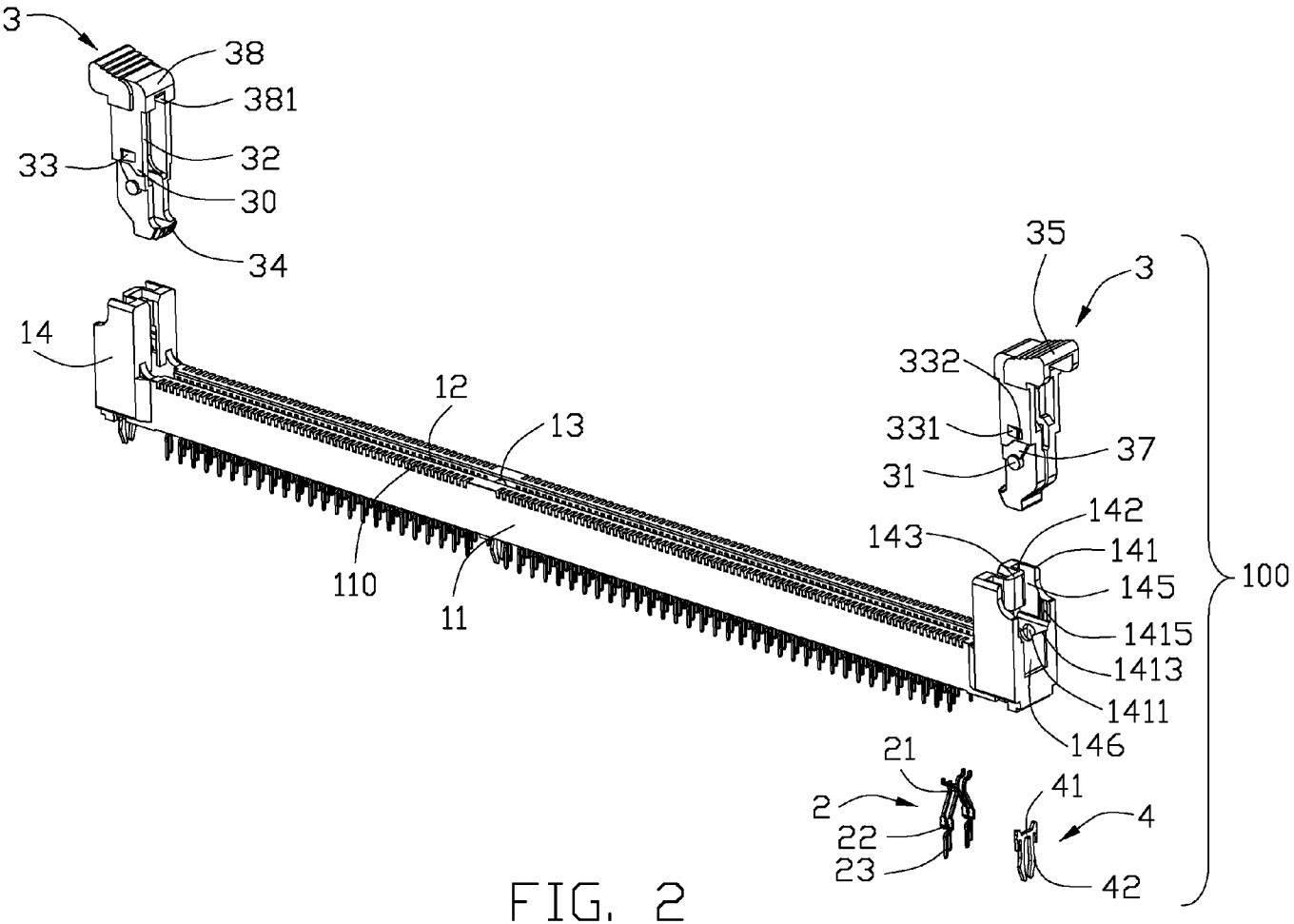
FIG. 2 is an explored, perspective view of the card edge connector as shown in FIG. 1.

Referring to FIG. 2, the housing 1 has a pair of longitudinal sidewalls 11, a central slot 12 formed between the sidewalls 11 and two towers 14 disposed on two longitudinal ends of the central slot 12. The sidewalls 11 define a plurality of contact passageways 110 communicating with the central slot 12 to receive the contacts 2, respectively. The central slot 12 is divided into two different parts with different lengths by a key 13 so as to prevent the daughter card from mismating.

Conjoined with FIG. 2, the tower 14 has two opposite outside walls 141, two opposite inner walls 142 located on inner sides of the outside walls 141 and an enhanced wall 143 connecting the two inner walls 142. The tower 14 defines a channel 145 formed by the outside wall 141, the inner wall 142 and the enhanced wall 143 and a receiving cavity 146 located between two outside walls 141. The receiving cavity 146 communicates with the channel 145 and the central slot 12. The outside wall 141 defines two pivoting holes 1411 to pivot the ejector 3, an obstruct surface 1413 surrounding the pivoting holes 1411 and an obstruct portion 1415 located on an outside of the channel 145.

The contact 2 has a retaining portion 22 retained in the passageways 110, a contact portion 21 extending into the central slot 12 from the retaining portion 22 to contact with the daughter card and a soldering leg 23 extending downwardly beyond the housing 1 from the retaining portion 22.

Figure 3:
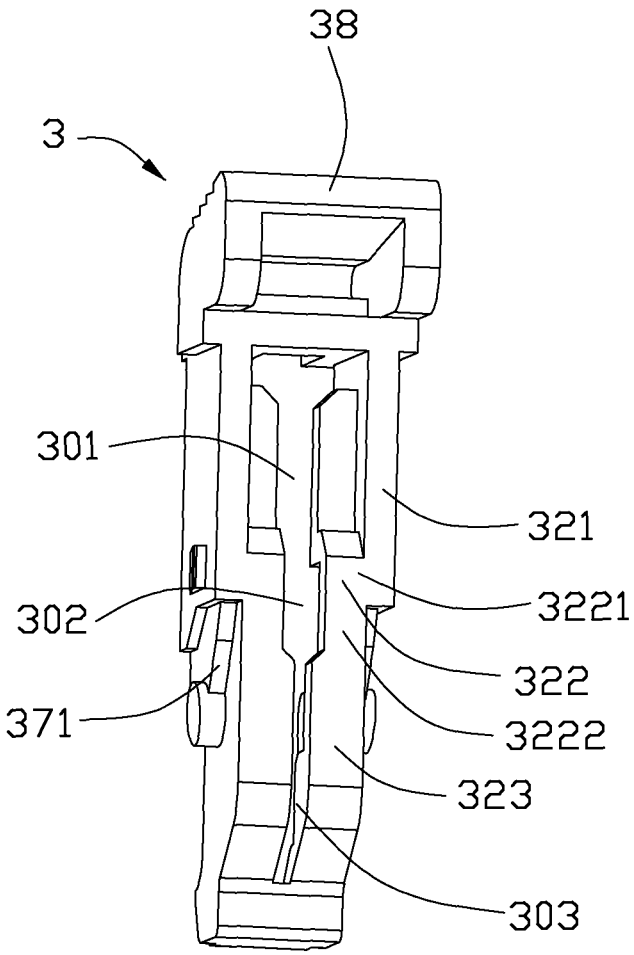
FIG. 3 is a perspective view of an ejector of the card edge connector.

Referring to FIG. 2 and FIG. 3, the ejector 3 has a base portion 30, an operating portion 35 extending outwardly from a top end of the base portion 30, a latch portion 38 extending inwardly from the top end of the base portion 30, an ejecting portion 34 inwardly protruding into the central slot 12 from a bottom end of the base portion 30 and two pivots 31 located on two out sides thereof. The pivots 31 are assembled to the pivoting holes 1411 of the housing 1 to make the ejector 3 capable of rotating inwardly or outwardly toward the central slot 12. The base portion 30 has two protrusions 33 and two bumps 37 on the two out sides thereof and both are located above the pivots 31. The protrusion 33 has a clined surface 331 extending toward the central slot 12 and a right angle surface 332 far away from the central slot 12.

The bump 37 has a restricting surface 371 abuts against the obstruct surface 1413 of the tower 14. The latch portion 38 has a clipping slit 381 on a bottom thereof. The base portion 30 includes a pair of elastic walls 32 and a slit formed between the elastic walls 32. The slit includes a first slit 301, a second slit 302 extending downwardly from the first slit 301 and a third slit 303 extending downwardly from the second slit 302. In a width direction of the housing 1, the widths of the first slit 301, the second slit 302 and the third slit 303 are decreased in turn. The two elastic walls 32 includes two first elastic walls 321 at two sides of the first slit 301, two second elastic walls 322 at two sides of the second slit 302 and two third elastic walls 323 at two sides of the third slit 303. The second elastic wall 322 connects the first elastic wall 321 and the third elastic wall 323. The second elastic wall 322 has a first connecting wall 3221 and a second connecting wall 3222 extending downwardly from the first connecting wall 3221. The first connecting wall 3221 upwardly connects with the first elastic wall 321 and an outside surface of the first connecting wall 3221 is coplanar with an outside surface of the first elastic wall 321, the inner surfaces of the first connecting wall 3221 and the second connecting wall 3222 are coplanar. A thickness of the second connecting wall 3222 is larger than that of the first elastic wall 321 but smaller than that of the third elastic wall 323, a thickness of the first connecting wall 3221 is equal to a sum of the thickness of the first elastic wall 321 and the thickness of the second connecting wall 3222, the protrusion 33 are located on two outsides of the first connecting wall 3221. In a height direction of the housing, a height of the first slit 301 is equal to a height that of third slit 303, a height of the second slit 302 is a half height of the first slit 301.

Referring to FIG. 1, the board locker 4 comprises a securing portion 41 retained in the housing 1 and a pair of legs 42 extending downwardly from the securing portion 41 to lock with the printed circuit board.

Referring to FIG. 2 and FIG. 3, the ejector 3 is received in the receiving cavity 146 of the tower 14. The daughter card downwardly presses the ejecting portion 34 to make the ejector 3 rotates inwardly when the daughter card insert in the card edge connector 100, the clined surface 331 of the protrusion 33 and the obstruct portion 1415 press each other to push the elastic wall 32 of the ejector 3 deflect inwardly and the outside wall 141 of the tower 14 deflect outwardly so as to make the protrusion 33 enter the channel 145. When the daughter card arrives its final position, the latch portion 38 abuts against downwardly the daughter card to prevent the daughter card from escaping out of the central slot 12, and the clipping slit 381 of the latch portion 38 clipps the daughter card to prevent the daughter card from swing in a width direction of the housing. So the daughter card is reliably locked in the card edge connector 100. At this status, the right angle surface 332 of the protrusion 33 abuts against the obstruct portion 1415, so that a needed force to open the ejector 3 is bigger than a force to close the ejector 3, to avoid the ejector 3 are open easily. When with drawn the daughter card from the card edge connector 100, the ejector 3 is rotated outwardly and the ejecting portion 34 thereof lifts up the daughter card by such a way that the daughter card leaves away from the central slot 12. At this status, the bump 37 of the ejector 3 abuts against downwardly the obstruct surface 1413 to prevent the ejector 3 from rotating outwardly overly.

In a width direction of the housing 1, the thicknesses of the first elastic wall 321 and the second connecting wall 3222 are thinner than that of the first connecting wall 3221 so that the elasticity of the elastic wall 32 is improved, for the protrusion 33 are located on two outsides of the first connecting wall 3221 with a big thickness, the protrusion 33 are not easily worn in an open/close process of the ejector 3. In addition, the thickness of the third elastic wall 323 is larger than that of the second connecting wall 3222 so that the strength of the ejector 3 is also improved, for this reason, the ejector 3 are not easily damaged in a process of open and close the ejector 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated insulative housing having an elongated central slot and at least a tower located at one end thereof, the tower having two opposite outside walls and a receiving cavity formed between the two outside walls;

a plurality of contacts retained in the housing; and an ejector pivoted on the housing and received in the receiving cavity of the tower, the ejector including a pair of elastic walls, a slit formed between the elastic walls and a pair of protrusions at two outer sides of the elastic walls to abut against the tower; wherein the elastic wall comprise a pair of first elastic walls and a pair of second elastic walls extending downwardly from the first elastic walls respectively, the second elastic walls comprises a first connecting wall upwardly connecting with the first elastic wall and a second connecting wall downwardly extending from the first connecting wall, a thickness of the first connecting wall is equal to a sum of a thickness of the first elastic wall and a thickness of the second connecting wall, wherein the elastic wall further comprises a pair of third elastic walls extending downwardly from the second elastic walls respectively, wherein the slit includes a first slit formed between the two first elastic walls, a second slit formed between the two second elastic walls and a third slit formed between the two third elastic walls, in a width direction of the housing, the widths of the first slit, the second slit and the third slit are decreased in turn.

2. The card edge connector as claimed in claim 1, wherein the protrusion are located on an outsider surface of the first connecting wall.

3. The card edge connector as claimed in claim 1, wherein an outside surface of the first connecting wall and an outside surface of the first elastic wall are coplanar, an inner surface of the first connecting wall and an inner surface of the second connecting wall are coplanar, the thickness of the second connecting wall is larger than that of the first elastic wall but smaller than that of the third elastic wall.

4. The card edge connector as claimed in claim 1, wherein in a height direction of the housing, a height of the first slit is equal to a height of the third slit, a height of the second slit is a half of that of the first slit.

5. The card edge connector as claimed in claim 1, wherein the slit extends through an outside surface of the ejector along a length direction of the housing.

6. The card edge connector as claimed in claim 1, wherein the ejector includes a base portion, an operating portion extending outwardly from a top end of the base portion, a latch portion extending inwardly from a top end of the base portion and an ejecting portion extending inwardly from a bottom side of the base portion, the slit is defined on the base portion and has a height same as that of the base portion along a height direction of the housing.

7. The card edge connector as claimed in claim 6, wherein the latch portion comprises a clipping slit clipping a daughter card to prevent the daughter card from swing in the width direction of the housing.

8. The card edge connector as claimed in claim 6, wherein the base portion further includes two pivots on two sides thereof and two bumps extending upwardly from the pivot; the housing includes an obstruct surface upwardly abuts against the bump to prevent the ejector from rotating outwardly overly.

9. A card edge connector, comprising:

an elongated insulative housing having an elongated central slot and at least a tower located at one end thereof, the tower having two relative outside walls and a receiving cavity formed between the outside walls;

a plurality of contacts retained in the housing; and an ejector pivoted on the housing and received in the receiving cavity of the tower, the ejector includes a pair of elastic walls, a slit formed between the elastic walls and a pair of protrusions at two outer sides of the elastic walls to abut against the tower; wherein the elastic walls comprise a pair of first elastic walls and a pair of second elastic walls extending downwardly from the first elastic walls respectively, the second elastic walls comprises a first connecting wall upwardly connecting with the first elastic wall and a second connecting wall downwardly extending from the first connecting wall, a thickness of the first connecting wall is larger than that of the first elastic wall and that of the second connecting wall, the protrusion is located on an outside surface of the first connecting wall, wherein elastic walls further comprise a pair of third elastic walls extending downwardly from the second elastic wall respectively, a thickness of the third elastic wall is larger than the thickness of the second connecting wall to improve the instructure strength of the ejector, wherein the elastic walls define a slit there between, the slit includes a first slit between the first elastic walls, a second slit between the second elastic walls and a third slit between the third elastic walls, and the second slit is wider than the third slit but narrower than the first slit.

10. The card edge connector as claimed in claim 9, wherein the first connecting wall has an outside surface coplanar with an outside surface of the first elastic wall.

11. The card edge connector as claimed in claim 10, wherein the first connecting wall has an inner surface coplanar with an inner surface of the second connecting wall.

12. A card edge connector comprising:

an insulative housing defining an elongated central slot extending along a lengthwise direction;

a pair of towers located at two opposite ends of the housing, one of said towers defining a receiving cavity with a pair of pivoting holes by two sides of said receiving cavity;

a plurality of contacts disposed in the housing beside the central slot;

an ejector received in the receiving cavity, said ejector including a pair of pivots respectively located on two opposite outward side faces of the ejector to be received in the corresponding pivoting holes, respectively, a slit formed in the ejector along a vertical direction, which is perpendicular to said lengthwise direction, and essentially symmetrical regard to said two opposite outward side faces; wherein a width of said slit measured in the transverse direction perpendicular to both said lengthwise direction and said vertical direction, varies in the vertical direction, wherein the slit defines a first width around a lower section of the ejector where said pair of pivots are located, and a second width around an upper section of the ejector where two opposite protrusions are formed on said two opposite outward side faces for engagement with the corresponding tower to lock the ejector in position in the receiving cavity, said second width being larger than the first width, wherein said slit is defined by a rear wall of the ejector.

13. The card edge connector as claimed in claim 12, wherein a stepped structure is formed the upper section of the ejector beside the slit so as to form a third width of the slit which is larger than the second width.

14. The card edge connector as claimed in claim 13, wherein the third width is defined by the rear wall.

* * * * *